US009988828B2

(12) United States Patent
Emory

(10) Patent No.: US 9,988,828 B2
(45) Date of Patent: Jun. 5, 2018

(54) METHOD AND APPARATUS FOR A REKEYABLE MASTER KEY LOCK

(75) Inventor: Mark W. Emory, Placentia, CA (US)

(73) Assignee: Spectrum Brands, Inc., Middleton, WI (US)

( * ) Notice: Subject to any disclaimer, the term of this patent is extended or adjusted under 35 U.S.C. 154(b) by 1171 days.

(21) Appl. No.: 13/555,457

(22) Filed: Jul. 23, 2012

(65) Prior Publication Data

US 2013/0086957 A1 Apr. 11, 2013

Related U.S. Application Data

(60) Provisional application No. 61/545,241, filed on Oct. 10, 2011.

(51) Int. Cl.

| | |
|---|---|
| ***E05B 29/06*** | (2006.01) |
| ***E05B 29/00*** | (2006.01) |
| ***E05B 27/00*** | (2006.01) |

(52) U.S. Cl.

CPC ..... *E05B 29/004* (2013.01); *E05B 27/005* (2013.01); *E05B 29/0046* (2013.01); *E05B 29/0066* (2013.01); *E05B 29/0033* (2013.01); *E05B 29/0073* (2013.01); *Y10T 29/49* (2015.01); *Y10T 70/7559* (2015.04); *Y10T 70/7599* (2015.04); *Y10T 70/7616* (2015.04)

(58) Field of Classification Search

CPC .. E05B 29/0066; E05B 29/0046; E05B 29/00; E05B 29/0013; E05B 29/004; E05B 29/0033; E05B 29/0073; E05B 29/08; E05B 27/005; Y10T 29/49; Y10T 70/7616; Y10T 70/7599; Y10T 70/7559

USPC .. 70/337–343, 382–385, 368, 492, 493, 495

See application file for complete search history.

(56) References Cited

U.S. PATENT DOCUMENTS

| | | | | |
|---|---|---|---|---|
| 4,712,402 | A | 12/1987 | Monahan | |
| 4,741,188 | A | 5/1988 | Smith | |
| 7,007,528 | B2 * | 3/2006 | Chong | E05B 29/004 70/383 |
| 7,874,191 | B2 | 1/2011 | Chiang | |
| 7,900,491 | B2 * | 3/2011 | Chong | E05B 27/005 70/383 |
| 7,980,104 | B1 * | 7/2011 | Huang | E05B 29/004 70/338 |
| 7,980,106 | B2 * | 7/2011 | Huang | E05B 29/004 70/340 |
| 9,657,499 | B2 * | 5/2017 | Emory | E05B 29/004 |
| 2004/0163433 | A1 | 8/2004 | Armstrong et al. | |
| 2008/0264127 | A1 | 10/2008 | Chiang | |

(Continued)

FOREIGN PATENT DOCUMENTS

WO WO2006/065609 6/2006

*Primary Examiner* — Lloyd A Gall

(74) *Attorney, Agent, or Firm* — Merchant & Gould P

(57) ABSTRACT

A rekeyable master keyable lock includes a plurality of key followers, a plurality of user racks and a plurality of master racks. One user rack and one master rack are associated with each key follower and are configured to be selectively disengaged from, and reengaged with, the key follower. When the user racks are disenggaged from the key follower, the valid user key can be replaced with a new user key. Reengaging the user racks with the key followers rekeys the lock cylinder to the new user key and invalidates the original user key. Similar functionality applies to rekeying the master key. Either the user key or the master key can be rekeyed without rekeying the other.

8 Claims, 13 Drawing Sheets

(56) References Cited

U.S. PATENT DOCUMENTS

| | | | | |
|---|---|---|---|---|
| 2009/0031774 | A1 | 2/2009 | Armstrong et al. | |
| 2011/0226027 | A1 | 9/2011 | Huang et al. | |
| 2013/0086958 | A1* | 4/2013 | Emory | E05B 29/004 70/495 |

* cited by examiner

METHOD AND APPARATUS FOR A REKEYABLE MASTER KEY LOCK

The present invention claims priority to Provisional Patent Application Ser. No. 61/545,241, filed Oct. 10, 2011, titled "Master Keyable Rekeyable Smart Key".

FIELD OF THE INVENTION

The present invention relates to mechanical keyed lock cylinders and particularly to lock cylinders that can be master keyed. More particularly, it relates to mechanical keyed lock cylinders capable of having user keys and master keys rekeyed without disassembly of the lock cylinder.

BACKGROUND OF THE INVENTION

When rekeying a cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

The present invention overcomes these and other disadvantages of conventional lock cylinders. The lock cylinder of the present invention operates in a transparent way that presents the familiar experience of inserting a key and rotating the key in the lock cylinder, as with current cylinders. However, in the present invention, that same familiar experience is used to rekey the lock cylinder. Thus, the user does not require any special knowledge, training, or tools to rekey the lock cylinder of the present invention.

Managers of multi-unit complexes such as, for example, apartment buildings or hotels, find the use of rekeyable locks to be particularly advantageous. In the past, when a user's lease expired, the manager or landlord had to change the locks to protect the security of the subsequent tenant by preventing the previous user from reentering the property. Rekeyable locks allow the manager to rekey the lock, thereby rendering the previous user's key obsolete, without removing the lock, saving time and money.

Managers also need to have access to their property when the current user is not available or when the user's key is lost or stolen. Rather than carry a duplicate key for each unit, which could become very cumbersome in large complexes, managers employ master keying systems that use special locks capable of being operated by two different keys. Such master keying systems allow each user to have a unique key while, at the same time, allowing the manager to operate all of the locks in a complex with one, or at most a few, master keys.

Unfortunately, as with conventional locks, master keying system locks typically require the manager to remove the cylinder mechanism from the lockset and then disassemble the cylinder to some degree to remove the plug and replace the pins. Access to master key system locks that can be quickly and easily rekeyed would be very advantageous to property managers. Even greater advantage would be derived from a master key system that allows both the user key and master key to be rekeyed.

Smith, in U.S. Pat. No. 4,741,188, discloses a rekeyable master keying system with a pin and tumbler design that uses master shims or wafers positioned in between the pins of the lock cylinder to establish a shear line for the master key and user keys. In Smith's cylinder, each rekeying operation involves completely removing one of the wafers from the lock cylinder. Unfortunately, that means that only a limited number of rekeying operations are available. Once a particular key bitting has been used, it cannot be reused without disassembling the lock cylinder to reinstall the missing wafer(s) necessary for that particular bitting. Moreover, the user keys and master keys require different notches to be cut in the spine of the key to accommodate the wafers at different pin positions, which adds complexity.

The present invention overcomes these disadvantages and others by providing a mechanical keyed lock cylinder capable of rekeying the user and master keys without completely eliminating previously used key combinations, thereby providing increased usability. In addition, the user key and master key utilize separate internal parts, thereby providing increased security.

SUMMARY OF THE INVENTION

The present invention includes a method of rekeying a master keyable lock cylinder having a keyway and a longitudinal axis. The method includes the steps of providing a plurality of key followers and a first plurality of racks coupled to the plurality of key followers wherein the first plurality of racks has a first configuration that aligns the first plurality of racks along a common axis in response to the presence of a first key with a first bitting in the keyway. The method also includes the steps of providing a second plurality of racks coupled to the plurality of key followers, wherein the second plurality of racks has a second configuration that aligns the second plurality of racks along a common axis in response to the presence of a second key with a second bitting in the keyway. Another step includes reconfiguring the first plurality of racks to align along a common axis in response to insertion of a third key with a third bitting while maintaining the second configuration of the second plurality of racks.

The method further includes the step of coupling one rack of the first plurality of racks and one rack of the second plurality of racks to the same key follower. The step of reconfiguring includes the step of decoupling the first plurality of racks from the plurality of key followers, and the step of decoupling includes the step of moving the first plurality of racks parallel to the longitudinal axis relative to the key followers.

The above described method can be used with a rekeyable master keyable lock cylinder that includes a keyway, a plurality of key followers, a plurality of user racks coupled to the plurality of key followers and configured to unlock the lock in response to insertion of a valid user key in the keyway, and a plurality of master racks coupled to the plurality of key followers and configured to unlock the lock in response to insertion of a valid master key in the keyway, wherein the plurality of key followers, the plurality of user racks and the plurality of master racks cooperate to allow the user key to be rekeyed independently of the master key and to allow the master key to be rekeyed independently of the user key.

DETAILED DESCRIPTION OF THE DRAWINGS

Figure 1:
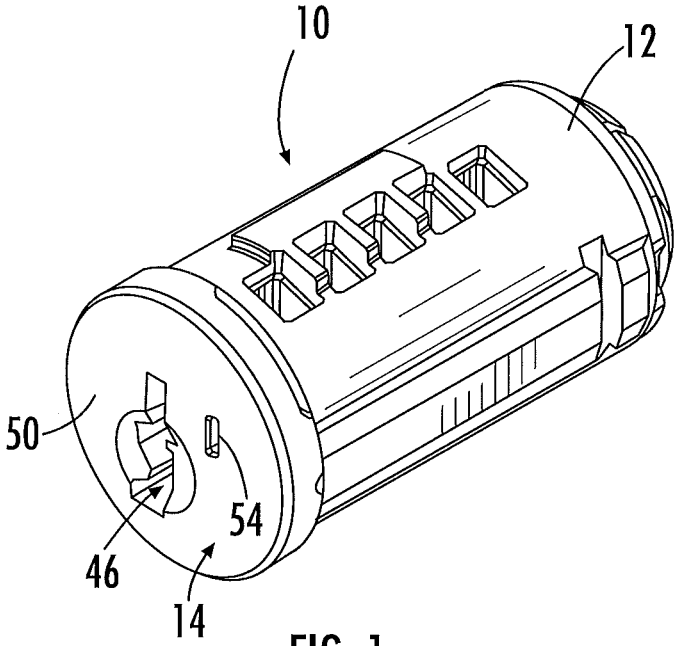
FIGS. 1-2 are views of an exemplary lock cylinder for use with the present invention.
Figure 2:
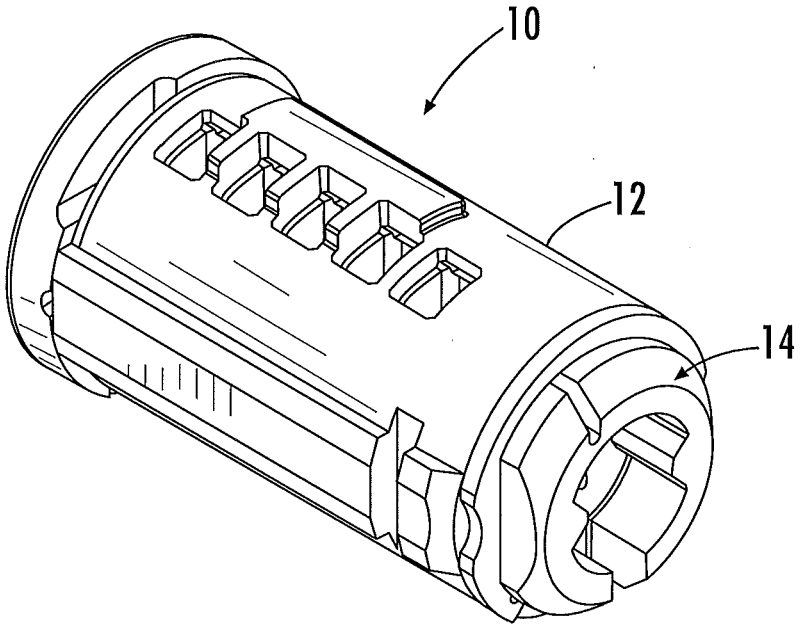
Figure 29:
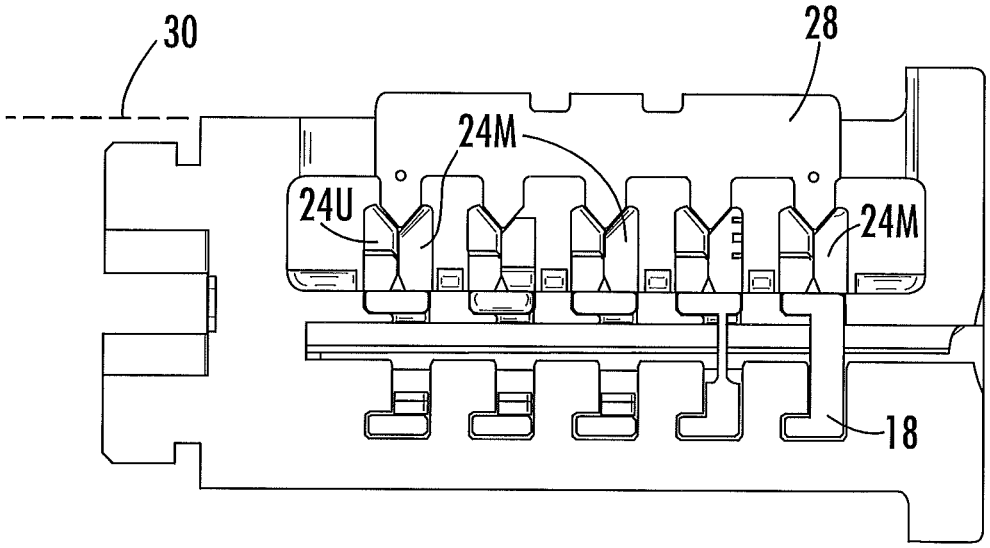
FIG. 29 is a section view illustrating the exemplary locking bar and racks with the lock cylinder in a locked condition.
Figure 30:
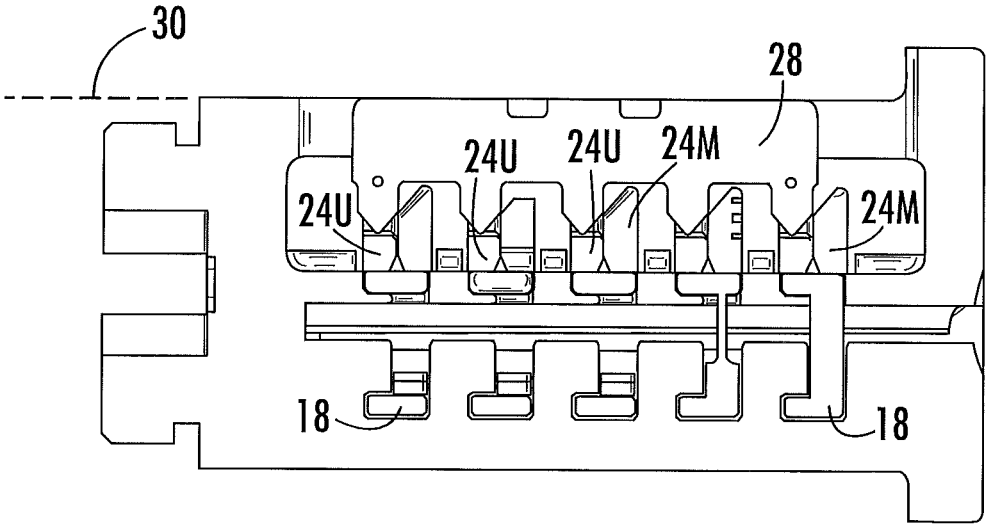
FIG. 30 is a section view illustrating the exemplary locking bar and racks with the lock cylinder in an unlocked condition.

One embodiment of a rekeyable master keyable lock cylinder 10 according to the present invention is illustrated in FIGS. 1 and 2. The lock cylinder 10 includes a housing 12 and a plug assembly 14 configured to rotate within the housing 12 and defining a shear line 30 therebetween (FIGS. 29-30). A retaining clip 15 engages the housing 12 and the plug assembly 14 to retain the plug assembly 14 in the housing 12.

Figure 3:
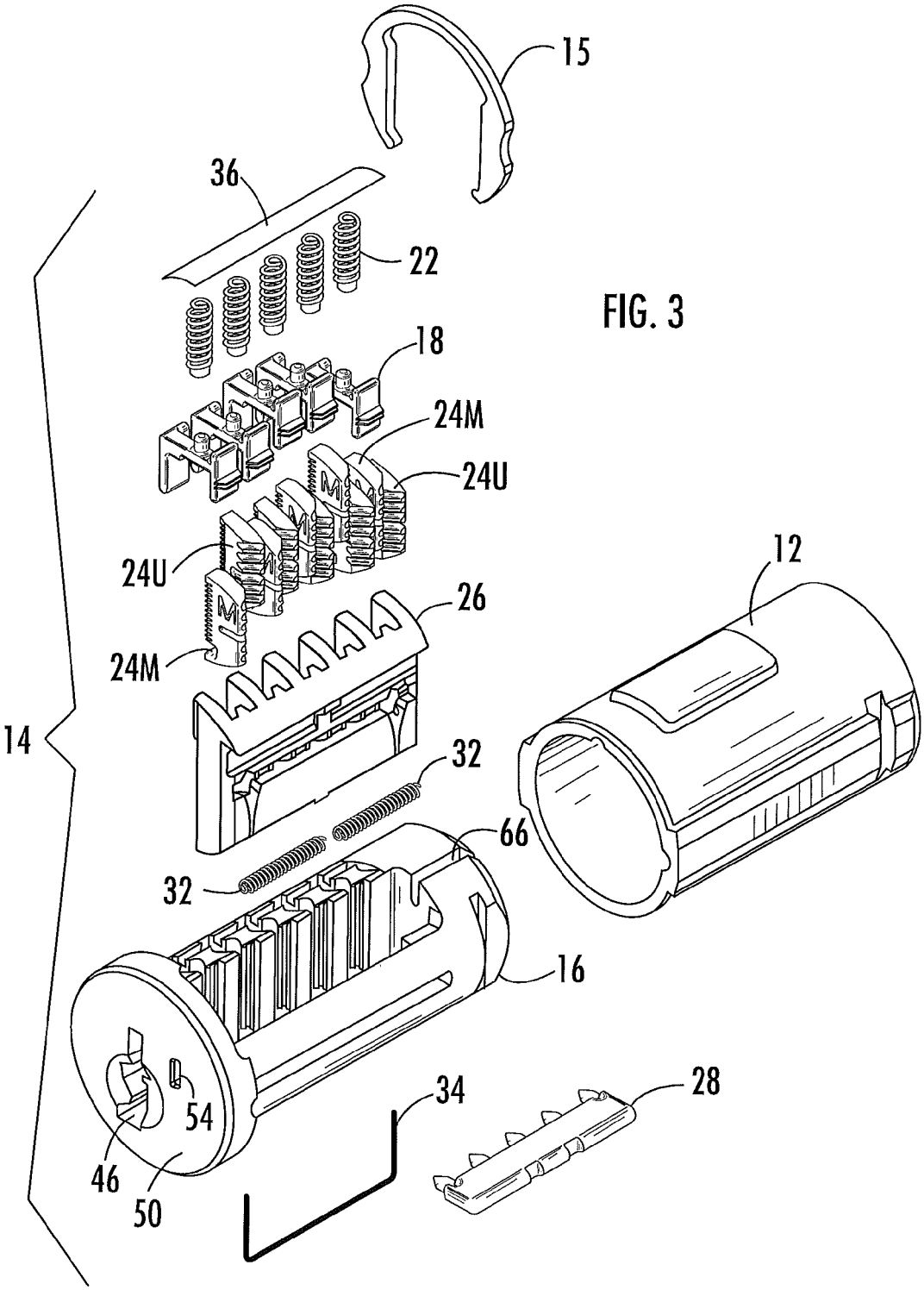
FIG. 3 is an exploded view of the lock cylinder of FIGS. 1-2.
Figure 5:
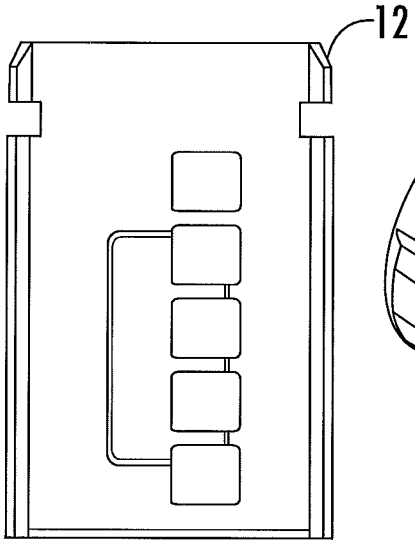
FIGS. 4-7 are views of an exemplary lock cylinder housing for use with the present invention.
Figure 4:
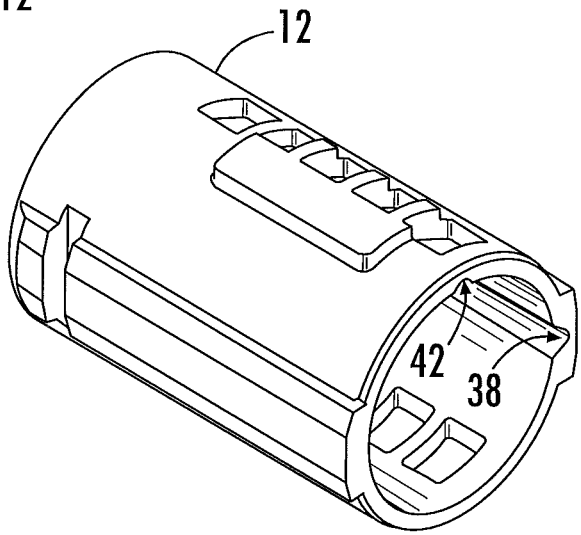
Figure 6:
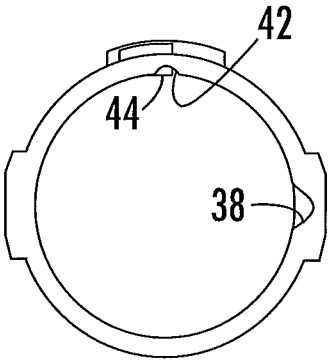
Figure 7:
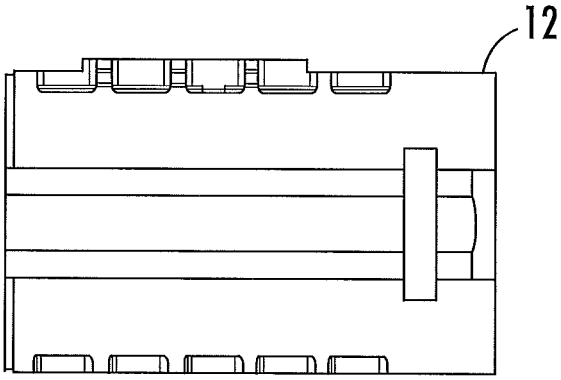

As illustrated in FIG. 3, the plug assembly 14 includes a plug body 16, a plurality of key followers or pins 18, a plurality pin springs or biasing elements 22 for biasing the key followers 18, a plurality of user racks and master racks 24U, 24M, a carrier 26 and a locking bar 28. A pair of carrier springs or biasing elements 32 bias the carrier 26 horizontally, while a U-shaped locking bar spring or biasing element 34 engages the locking bar 28. A spring retainer 36 is operatively disposed to retain the springs 22 in the plug body 16.

As illustrated in FIGS. 4-7, the housing 12 includes a first longitudinally extending locking bar recess 38 for receiving the locking bar 28 when the lock cylinder 10 is in the locked condition and a second locking bar receiving recess 42 for receiving the locking bar 28 when the lock cylinder 10 is in the learn condition. A locking bar retaining boss 44 (FIGS. 6 and 33) extends into the second locking bar receiving recess 42 to retain the locking bar 28 in the learn condition.

Figure 8:
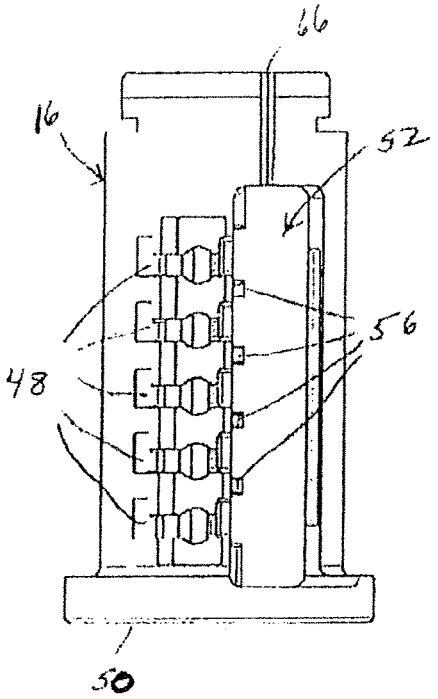
FIGS. 8-9 are views of an exemplary plug for use with the present invention.
Figure 9:
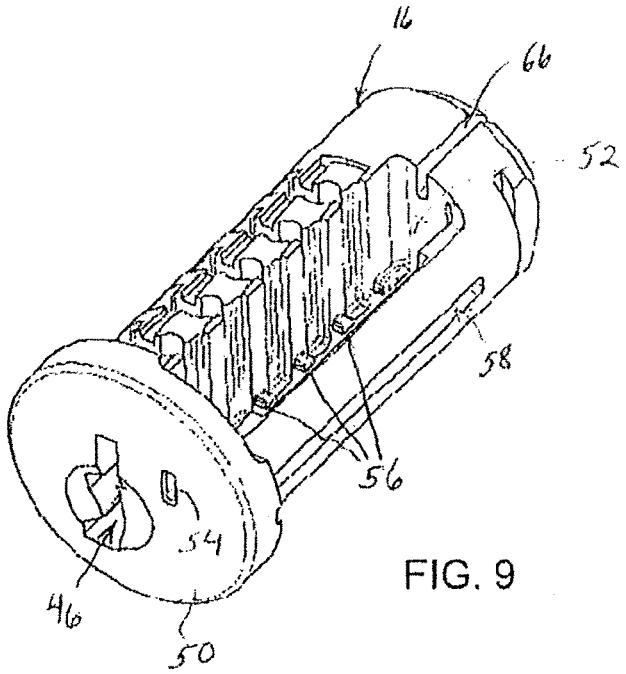
Figure 10:
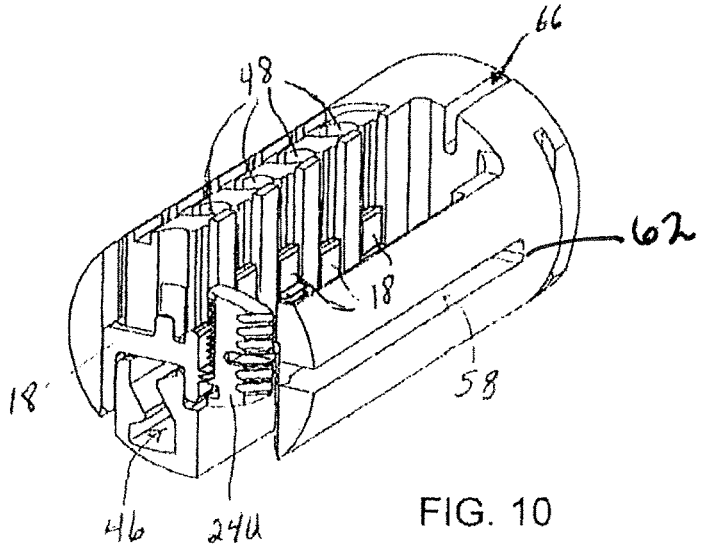
FIG. 10 illustrates an exemplary key follower and rack disposed in a plug body.
Figure 11:
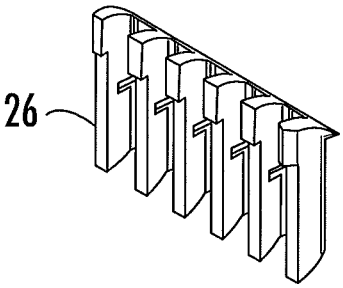
FIGS. 11-17 are views of an exemplary carrier for use with the present invention.
Figure 12:
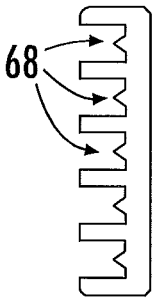
Figure 13:
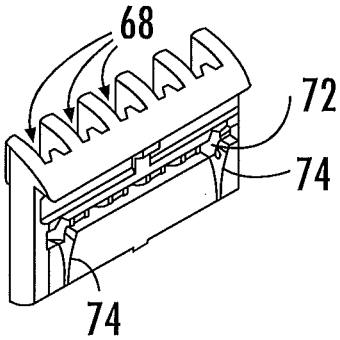
Figure 14:
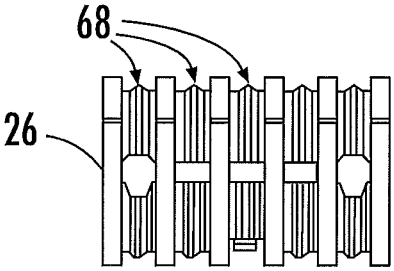
Figure 15:
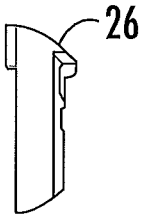
Figure 16:
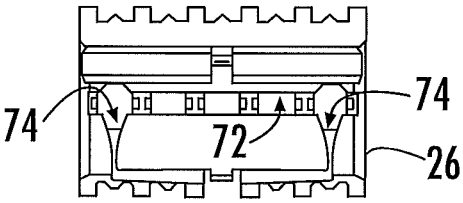
Figure 17:
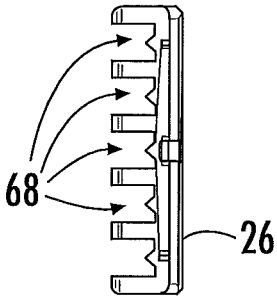
Figure 34:
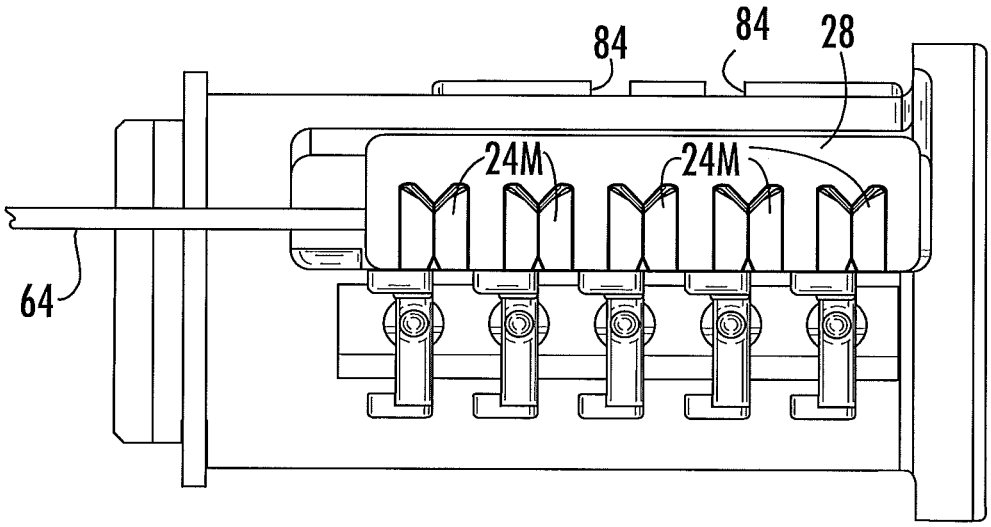
FIG. 34 is a plan view illustrating the exemplary carrier and racks relative to the exemplary key follower in a master key learn configuration.

As illustrated in FIGS. 8-10, the plug body 16 includes a plug face 50, a keyway 46 extending through the plug face 50, a plurality of pin chambers 48, and a cavity 52 for receiving the carrier 26 and racks 24U, 24M. The plug face 50 further includes an aperture 54 for receiving a rekeying tool 64 (FIG. 34). A plurality of learning bullets 56 extend into the cavity 52 and are configured to engage the racks 24U, 24M. A locking bar receiving slot 58 extends longitudinally along the length of the cavity 52 and extends radially from the cavity 52 to the outer surface 62 of the plug body 16. The distal end of the plug body 16 includes a slot 66 for receiving the rekeying tool 64. The aperture 54 is used to rekey the user key while the slot 66 is used to rekey the master key.

FIGS. 11-17 illustrate the carrier 26. The carrier 26 includes a plurality of rack recesses 68 and a locking bar receiving slot extension 72 that extends into each rack recess 68. Each rack recess 68 is M-shaped to accommodate a user rack 24U in a side-by-side relationship with its related master rack 24M. Two vertically oriented V-shaped recesses 74 are formed on the back wall of the carrier 26 to receive the locking bar spring 34.

Figure 18:
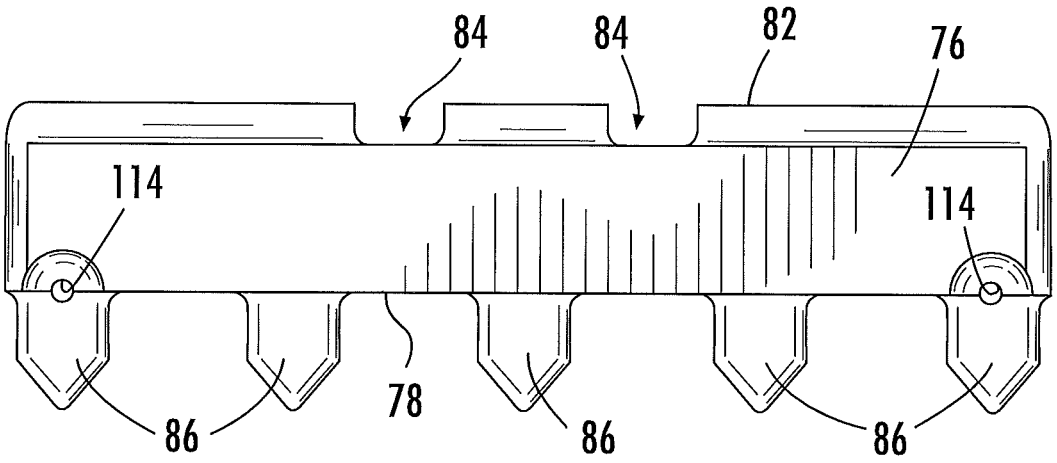
FIGS. 18-19 are views of an exemplary locking bar for use with the present invention.
Figure 19:
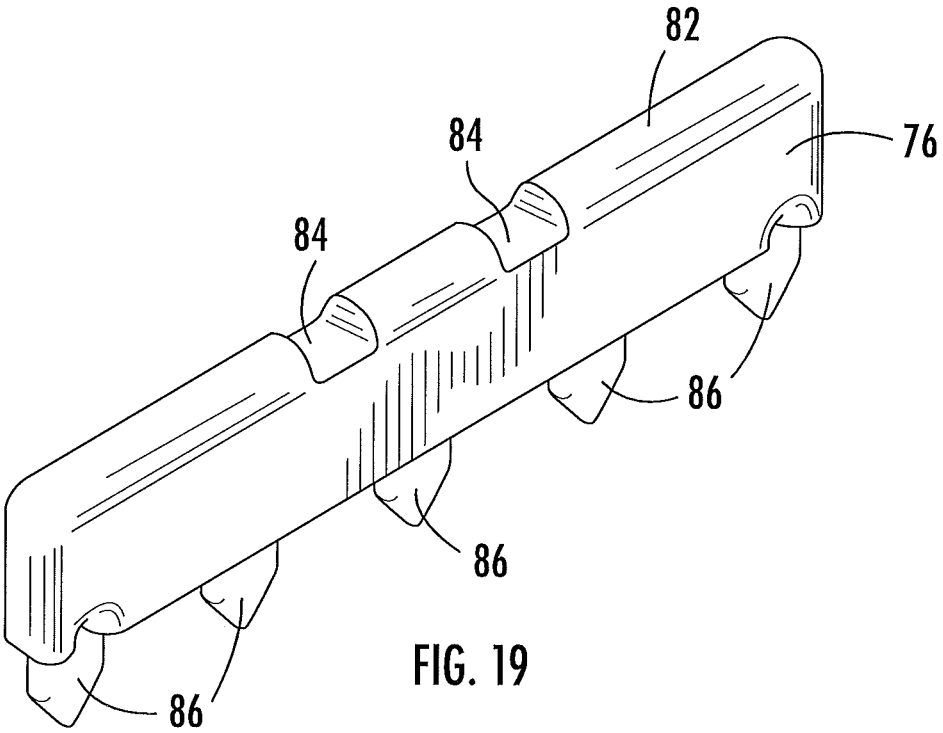
Figure 20:
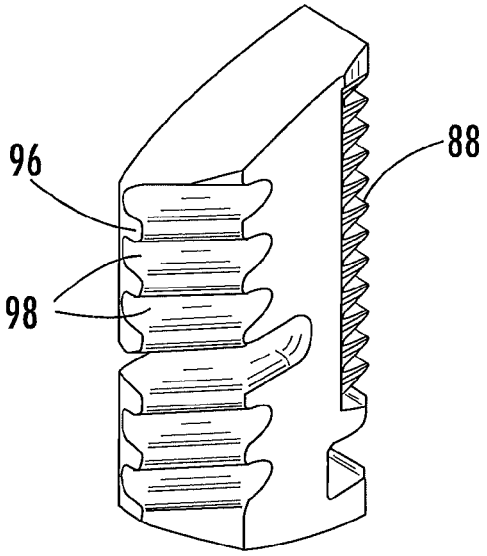
FIGS. 20-23 are views of an exemplary master rack for use with the present invention, with an exemplary user rack being the mirror image thereof.
Figures 21, 22, 23:
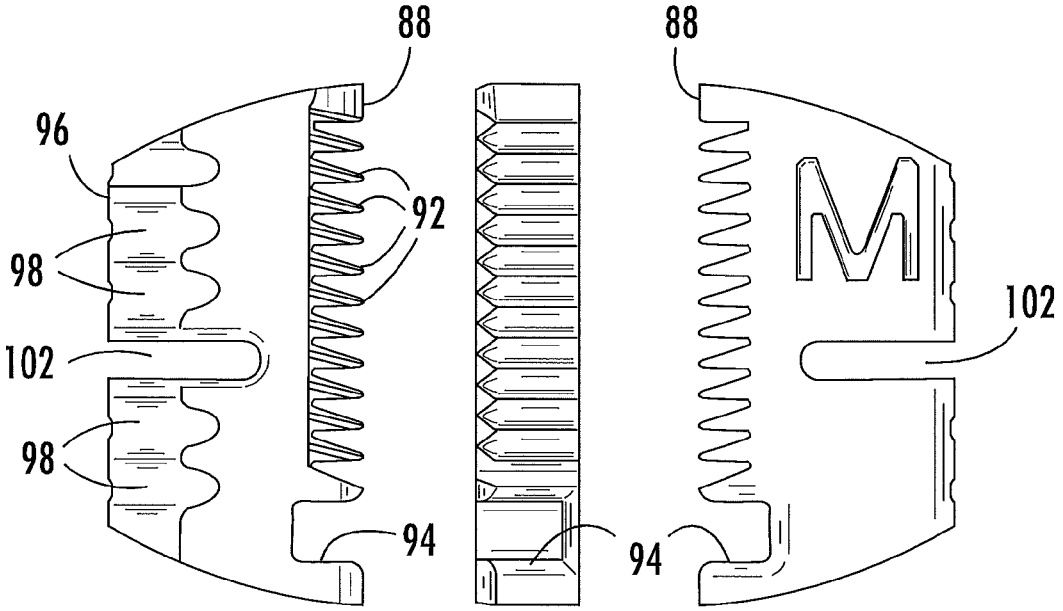

The locking bar 28, as illustrated in FIGS. 18-19, includes a body 76 having a leading edge 78 and a trailing edge 82. Two notches 84 are formed in the trailing edge 82 for receiving the locking bar retaining boss 44. A plurality of V-shaped tabs extends from the leading edge 78 to operatively engage the user racks 24U or master racks 24M.

FIGS. 20-23 illustrate an exemplary master rack 24M, wherein the user rack 24U would be a mirror image. The master rack 24M includes a key follower engagement edge 88 having a plurality of gear teeth 92 and a learning bullet receiving notch 94. A beveled edge 96 opposite the engagement edge 88 includes a plurality of guide channels 98 for guiding the V-shaped tabs 86 of the locking bar 28 and a receiving slot 102 for receiving the V-shaped tabs 86.

Figure 24:
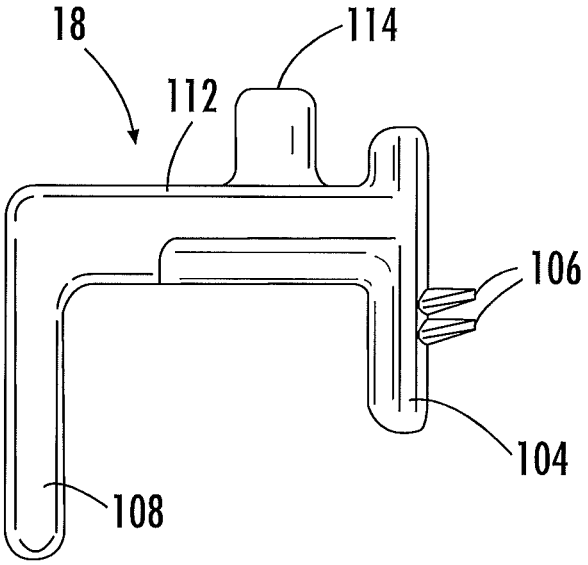
FIGS. 24-25 are views of an exemplary key follower for use with the present invention.
Figure 25:
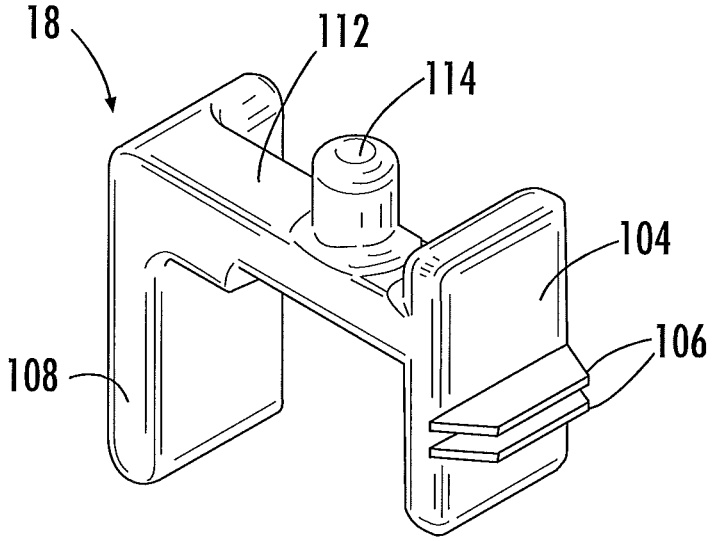

An exemplary pin or key follower 18 is illustrated in FIGS. 24-25. The pin 18 includes a first leg 104 that may have a pair of gear teeth 106 that are configured to engage the gear teeth 92 of a rack 24U, 24M. A second leg 108 is connected to the first leg 104 by a bridge portion 112. The bridge portion 112 includes a spring engaging boss 114 for engaging the pin spring 22. Each key follower 18 is associated with a user rack 24U and a master rack 24M.

Figure 26:
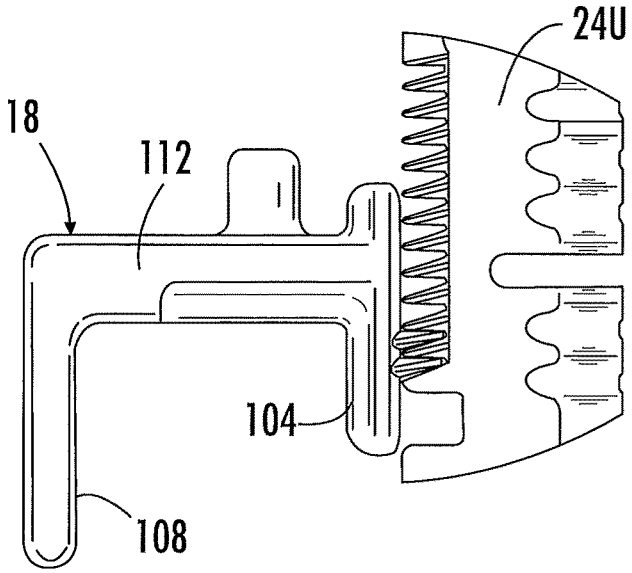
FIGS. 26-27 are views of exemplary racks engaging an exemplary pin follower.
Figure 27:
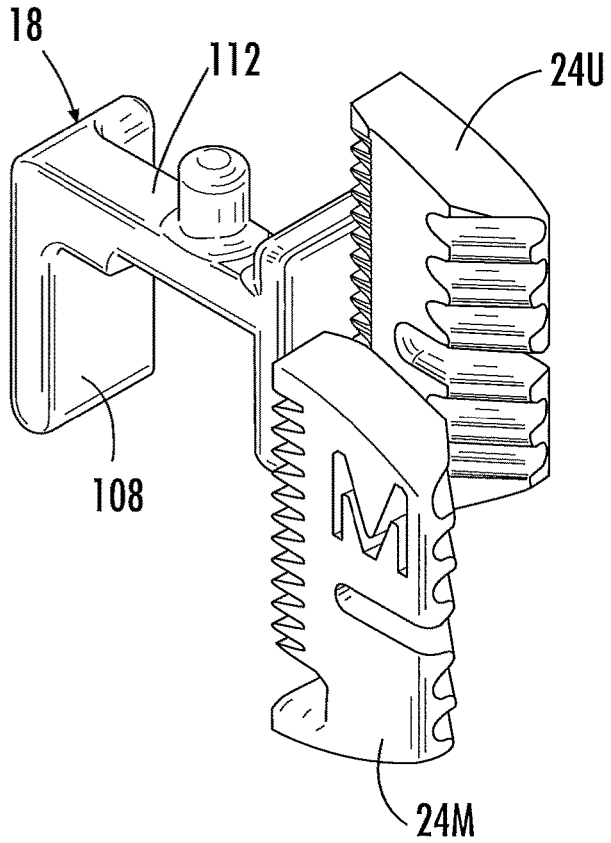
Figure 28:
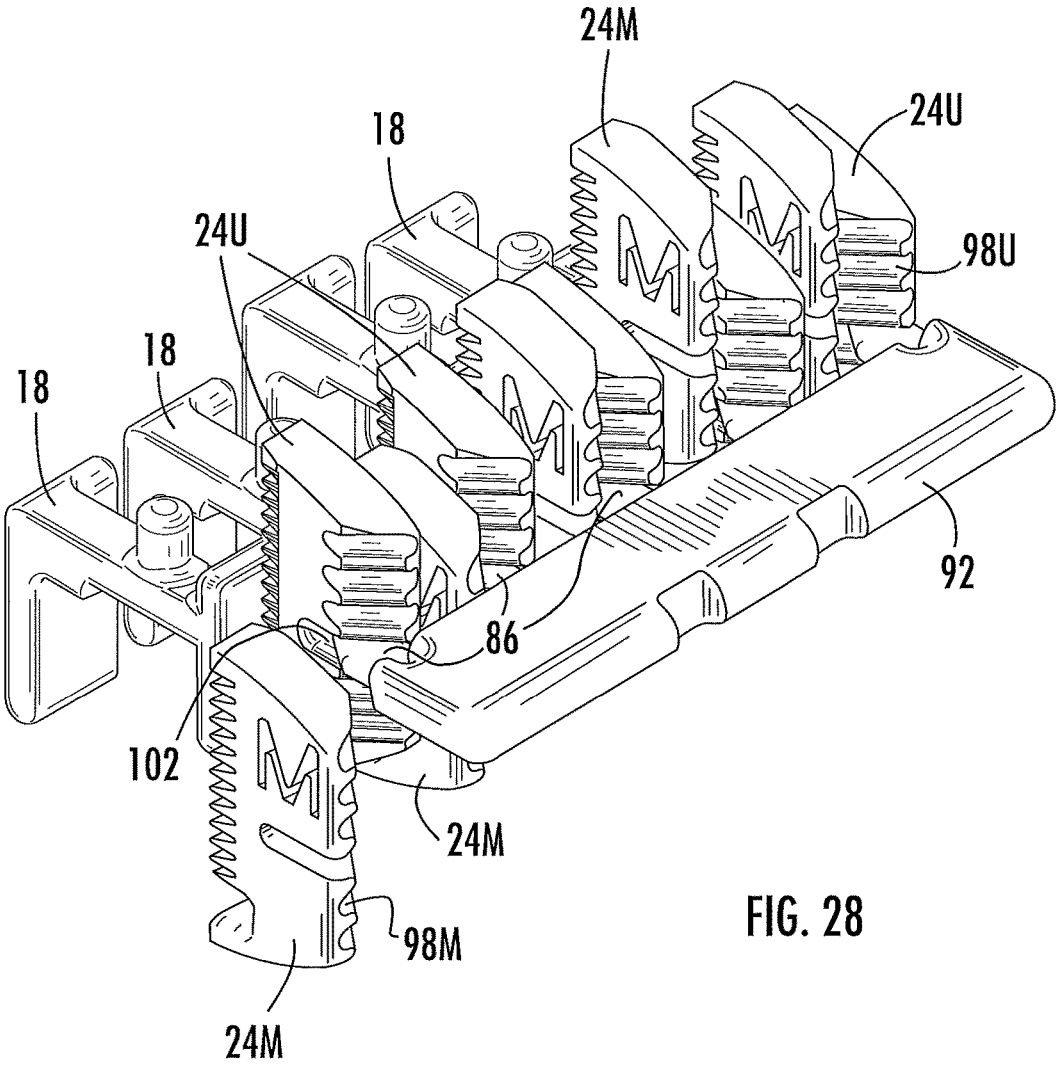
FIG. 28 illustrates the relationship between exemplary pin followers, racks, and locking bar.

An exemplary engagement of rack gear teeth 92 with the key follower gear teeth 106 is illustrated in FIG. 26. FIG. 27 illustrates a pairing of a user rack and a master rack 24U, 24M as they might be operatively engaged with a key follower 18. FIG. 28 illustrates four key followers 18 engaged their respective user and master racks 24U, 24M. In FIG. 28, the user racks 24U are aligned such that their receiving slots 102U lie along a common axis to receive the V-shaped tabs 86 in the receiving slot 102U.

Normal Operation

FIGS. 29 and 30 illustrate the change in the relative positioning of the locking bar 28 and the user and master racks 24U, 24M as the plug assembly 14 rotates in the housing 12. In FIG. 29, the lock cylinder 10 is in the locked condition with the locking bar 28 disposed in the 1$^{st}$ locking bar recess 38 and across the shear line 30. When a valid user key is inserted into the keyway 46, the racks 24U, 24M move up and down with the key bitting. When the valid user key is fully inserted in the keyway 46, the user racks 24U are aligned as illustrated in FIG. 28, with the slots 102U aligned along a common axis.

As the key is rotated, the locking bar 28 cams out of the $1^{st}$ locking bar recess 38. As the locking bar 28 cams out of the recess 38, the V-shaped tabs 86 are pushed against the master rack guide channels 98M which, in turn, guide the V-shaped tabs 86 into the user rack receiving slot 102U. When the tabs 86 enter the user rack receiving slots 102U, the locking bar 28 clears the shear line 30, allowing the plug assembly 14 to rotate in the housing 12.

If a non-valid key is inserted, the racks 24U will be moved to a position wherein at least one of the receiving slots 102U will not align along the common axis. In that case, attempting to rotate the plug assembly 14 in the housing 12 will force the V-shaped tab 86 to engage the opposing guide channel of the misaligned rack 24U instead of the receiving slot 102U, thereby preventing the locking bar 28 from camming out of the first locking bar recess 38. With the locking bar 28 unable to cam out of the recess 38, the locking bar 28 remains disposed across the shear line 30, thereby preventing the plug assembly 14 from rotating in the housing 12.

The same functionality applies to the master key as well. When a valid master key is inserted, the master racks 24M are aligned to receive the V-shaped tabs 86 in the receiving slots 102M. Rotation of the plug assembly 14 in the housing 12 pushes the tabs 86 along the user rack guide channels 98 and into the master rack receiving slots 102M, thereby clearing the locking bar 28 from the shear line 30 and allowing the plug assembly 14 to rotate in the housing 12.

An invalid master key incurs the same blocking action of the V-shaped tabs 86 as the invalid user key, keeping the locking bar 28 disposed across the shear line 30.

Rekeying Operation

Rekeying the lock cylinder 10 to accept a new user key is accomplished by disengaging the user racks 24U from the key followers 18 and replacing the original valid key with a new valid key having different bitting, and then reengaging the user racks 24U with the key followers 18. Disengaging the racks 24U from the key followers 18 allows the user racks 24U to move vertically to a new position relative to the key follower 18 based on the bitting of the new key.

Figure 31:
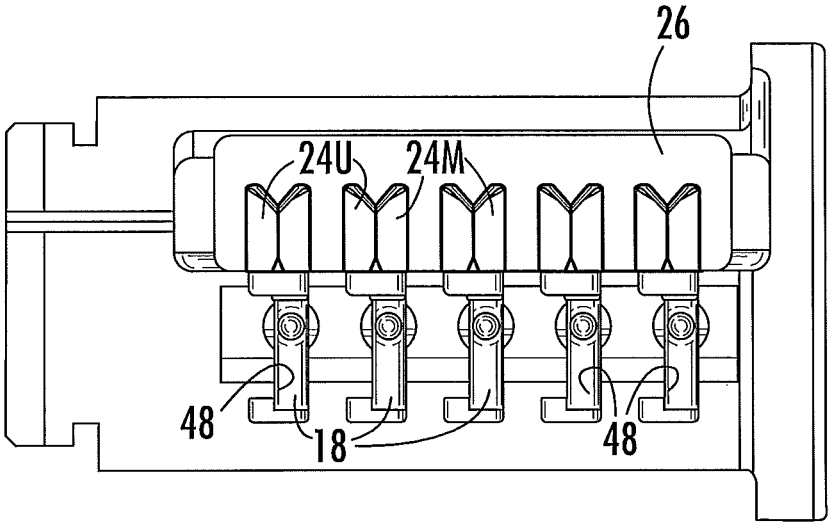
FIG. 31 is a plan view illustrating the exemplary carrier and racks relative to the exemplary key followers in a normal operating condition.

FIG. 31 illustrates the key followers 18 engaged with their respective user and master racks 24U, 24M, wherein the racks 24U, 24M are disposed in the rack recesses 68 of the carrier 26. Movement of the carrier 26 parallel to the longitudinal axis A of the lock cylinder 10 moves the racks 24U, 24M longitudinally relative to the key followers 18.

Figure 32:
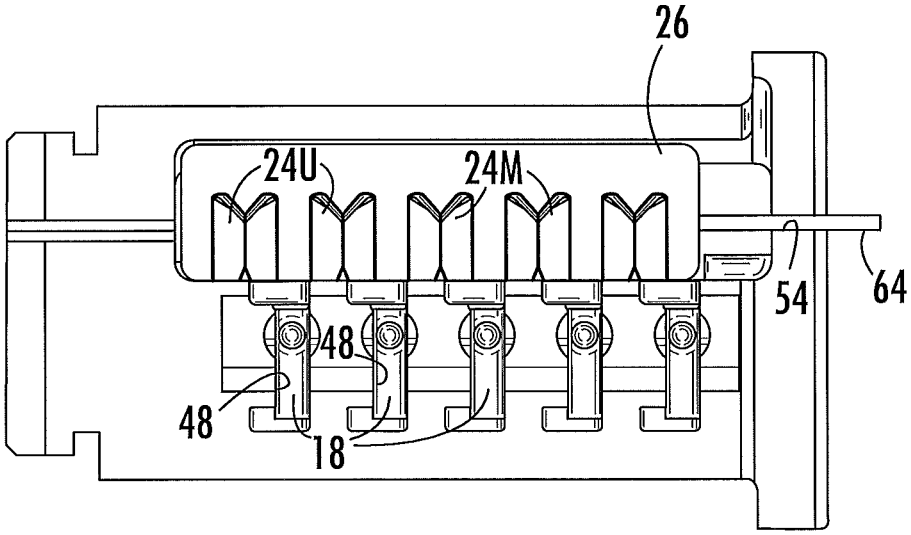
FIG. 32 is a plan view illustrating the exemplary carrier and racks relative to the exemplary key follower in a user key learn configuration.

When a user inserts a valid user key the user racks 24U align along a common axis, as previously discussed. The user can then rotate the plug assembly 14 to a predetermined position, the learn position. When the plug assembly 14 is in the learn position, the user inserts a rekeying tool 64 into the tool receiving aperture 54 and pushes against the carrier 26 toward the rear of the plug body 16, as illustrated in FIG. 32. The resultant longitudinal movement of the carrier displaces the user racks 24U longitudinally and disengages the user racks 24U from the key followers 18. While in the longitudinally displaced position, the learning bullet receiving notches 94 on the racks 24U engage the learning bullets 56, thereby retaining the alignment of the racks 24U. Once the user racks 24U are engaged with the learning bullets 56, i.e., in a rekeying configuration, the valid user key can be removed and a second key can be inserted into the keyway 46. The user then rotates the plug assembly 14 back to the original or home position to rekey the lock cylinder 10 to the second key and invalidate the first valid key.

Figure 33:
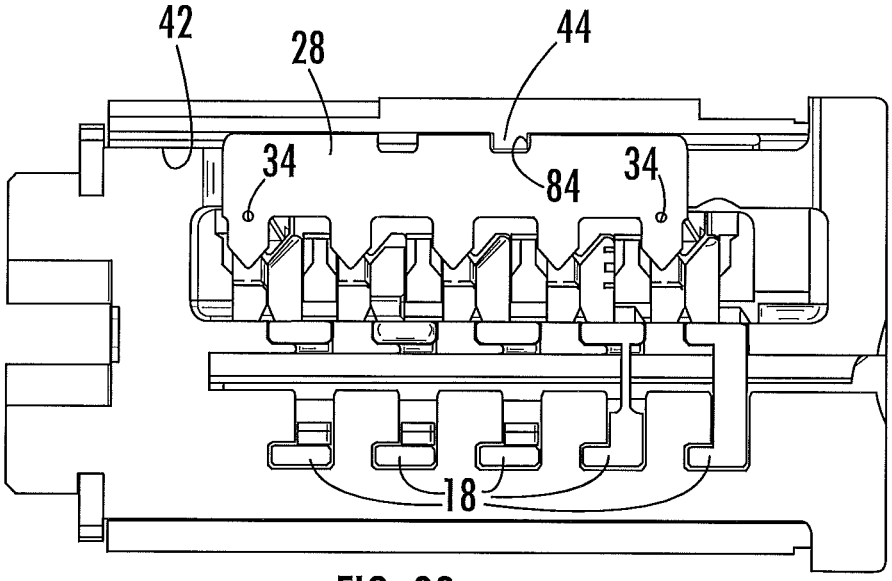
FIG. 33 is a section view illustrating the exemplary locking bar selectively engaging an exemplary rack in the learn configuration.

When the carrier 26 is displaced longitudinally, the locking bar 28 also moves longitudinally toward the rear of the plug body 16, as illustrated in FIG. 33, due to the positioning of the V-shaped tabs 86 in the user rack receiving slots 102. The longitudinal displacement of the locking bar 28 moves one of the notches 84 in its trailing edge 82 into alignment with the locking bar retaining boss 44 in the $2^{nd}$ locking bar recess 42. The U-shaped locking bar spring 34, being disposed in apertures 114, biases the locking bar 28 radially outwardly, thereby moving the notch 84 to receive the locking bar retaining boss 44 and allowing the locking bar 28 to enter the $2^{nd}$ locking bar recess 42.

With the boss 44 in the notch 84, the plug assembly 14 is held in the learning position and the carrier 28 is retained in the longitudinally displaced position. At this point, the master racks 24M are still engaged with the key followers 18, thereby retaining their respective keying positions to ensure that the valid master key will continue to operate the lock cylinder 10. When the first valid key is removed, the master racks 24M move up and down with the key followers 18 according to the key bitting. The user racks 24U, on the other hand, are disengaged from the key followers 18 and locked in position by the learning bullets 56. As such, they are unaffected by the movement of the key followers 18.

When second key is inserted and rotated back to the home position, the locking bar 28 cams out of the $2^{nd}$ locking bar recess 42, disengaging the locking bar retaining boss 44 from the notch 84. The carrier spring 32 biases the carrier 28 back to its original position, thereby reengaging the user racks 24U with the key followers 18. Since the user racks 24U were aligned along the common axis when they reengaged the key followers 18, they automatically assume the appropriate position to operate with the second key. Thus the second key becomes the valid user key and the original valid key is no longer operable.

The same functionality applies to rekeying the master key. To rekey a master key, the plug assembly 14 is rotated to the learn position and a rekeying tool 64 is inserted into the slot 66 in the rear of the plug body 16. The carrier 26 moves toward the face 50 of the plug body 16, moving the master racks 24M out of engagement with the key followers 18. The second notch 84 on the locking bar 28 engages the boss 44 to retain the carrier and racks 24U, 24M in position. In all other respects, the master key rekeying process is the same as the user key rekeying process.

While the present invention has been described with particular reference to a preferred embodiment of a lockset mechanism, one skilled in the art will recognize that the present invention may be readily adapted to embodiments other than those described with reference to the preferred embodiments. Furthermore, those skilled in the art will readily recognize from the foregoing discussion and accompanying drawings and claims, that changes, modifications and variations can be made in the present invention without departing from the spirit and scope thereof as defined in the following claims.

The invention claimed is:

1. A method of rekeying a master rekeyable lock cylinder having a keyway and a longitudinal axis comprising the steps of:

providing a plurality of key followers;

providing a first plurality of racks coupled in a first keying position to the plurality of key followers, the first plurality of racks having a first valid position that aligns the first plurality of racks along a common axis by having slots of the first plurality of racks engage a locking bar in response to the presence of a first key with a first bitting in the keyway;

providing a second plurality of racks coupled in a second keying position to the plurality of key followers, the second plurality of racks having a second valid position that aligns the second plurality of racks along the common axis by having slots of the second plurality of racks engage the locking bar in response to the presence of a second key with a second bitting in the keyway, the second key bitting different than the first key bitting; and repositioning the first plurality of racks to realign along the common axis by having slots of the first plurality of racks reengage the locking bar in response to insertion of a third key with a third bitting, different than the first key bitting, while retaining the second keying position of the second plurality of racks with respect to the plurality of key followers, wherein the first plurality of racks are paired with the second plurality of racks via the key followers.

2. The method of claim 1 further including the step of coupling one rack of the first plurality of racks and one rack of the second plurality of racks to the same key follower.

3. The method of claim 1 wherein the step of repositioning includes the step of decoupling the first plurality of racks from the plurality of key followers.

4. The method of claim 3 wherein the step of decoupling includes the step of moving the first plurality of racks parallel to the longitudinal axis relative to the key followers.

5. A method of rekeying a master rekeyable lock having a longitudinal axis comprising the steps of:

providing a plug assembly having a keyway and being rotatable within a housing in response to insertion of a first key having a first key bitting and a second key having a second key bitting in the keyway, the second key bitting different than the first key bitting;

providing a plurality of key followers disposed in the plug assembly;

providing a first plurality of racks and a second plurality of racks disposed in the plug assembly coupled to the plurality of key followers;

inserting the first key;

aligning the first plurality of racks in a first valid position that aligns the first plurality of racks along a common axis by having slots of the first plurality of racks engage a locking bar;

disengaging the first plurality of racks from the plurality of key followers, removing the first key, and inserting a third key having a third key bitting; and reengaging the first plurality of racks with the plurality of key followers to provide a second valid position that aligns the first plurality of racks along the common axis by having slots of the first plurality of racks reengage the locking bar, thereby rendering the first key unable to align the first plurality of racks along the common axis by having slots of the first plurality of racks engage the locking bar, wherein the first plurality of racks are paired with the second plurality of racks via the plurality of key followers.

6. The method of claim 5 further including the steps of:

inserting the second key;

aligning the second plurality of racks in a third valid position that aligns the second plurality of racks along a common axis by having slots of the second plurality of racks engage the locking bar;

disengaging the second plurality of racks from the plurality of key followers;

removing the second key and inserting a fourth key having a fourth key bitting; and reengaging the second plurality of racks with the plurality of key followers to provide a fourth valid position that aligns the second plurality of racks along the common axis by having slots of the second plurality of racks reengage the locking bar, thereby rendering the second key unable to align the second plurality of racks along the common axis by having slots of the second plurality of racks engage the locking bar.

7. A method of rekeying a master rekeyable lock comprising:

providing a lock cylinder configured to be unlocked using both a first user key and a first master key such that the first user key and the first master key can each independently unlock the lock cylinder;

providing a plurality of key followers disposed in the lock cylinder;

providing a plurality of user racks coupled to the plurality of key followers and configured to be responsive to insertion of the first user key to form a first rekeying configuration;

rekeying the lock cylinder such that the first user key with a first user key bitting is replaced by a second user key having a different bitting than the first user key bitting, wherein, upon rekeying, the plurality of user racks coupled to the plurality of key followers are configured to be responsive to insertion of the second user key to form the first rekeying configuration;

providing a plurality of master racks coupled to the plurality of key followers and configured to be responsive to insertion of the first master key to form a second rekeying configuration; and rekeying the lock cylinder such that the first master key with a first master key bitting is replaced by a second master key having a different bitting than the first master key bitting, wherein, upon rekeying, the plurality of master racks coupled to the plurality of key followers are configured to be responsive to insertion of the second master key to form the second rekeying configuration, wherein the plurality of user racks are paired with the plurality of master racks via the plurality of key followers.

8. A method of rekeying a master rekeyable lock comprising the steps of:

providing a lock cylinder configured to be unlocked using both a user key with a user key bitting and a master key with a master key bitting such that the user key and the master key can each independently unlock the lock cylinder;

providing a plurality of key followers;

providing a first plurality of racks coupled to the plurality of key followers;

providing a second plurality of racks coupled to the plurality of key followers;

providing a locking bar configured to engage one of: the first plurality of racks and the second plurality of racks to selectively replace either the user key or the master key; and replacing the user key or master key with a different user key or master key, respectively, that is configured to unlock the lock cylinder, the different user key or master key having a different bitting than the user key bitting or the master key bitting, wherein the first plurality of racks are paired with the second plurality of racks via the plurality of key followers.

* * * * *